US012257470B1

(12) United States Patent
Milich

(10) Patent No.: US 12,257,470 B1
(45) Date of Patent: Mar. 25, 2025

(54) ADAPTIVE DUMBBELL HOLDER FOR INTERGRATION INTO A PULLEY SYSTEM FOR RESISTANCE EXERCISE

(71) Applicant: Jacob R. Milich, Milich, FL (US)

(72) Inventor: Jacob R. Milich, Milich, FL (US)

( * ) Notice: Subject to any disclaimer, the term of this patent is extended or adjusted under 35 U.S.C. 154(b) by 85 days.

(21) Appl. No.: 18/236,757

(22) Filed: Aug. 22, 2023

(51) Int. Cl.
*A63B 21/072* (2006.01)
*A63B 21/00* (2006.01)
*A63B 21/062* (2006.01)

(52) U.S. Cl.
CPC ..... *A63B 21/0726* (2013.01); *A63B 21/062* (2013.01); *A63B 21/151* (2013.01)

(58) Field of Classification Search
CPC ..... A63B 21/0722; A63B 21/0724; A63B 21/0726; A63B 21/0728; A63B 21/075
See application file for complete search history.

(56) References Cited

U.S. PATENT DOCUMENTS 4,109,907 A 8/1978 Zito
4,998,723 A 3/1991 Santoro
5,072,934 A 12/1991 Blanes
8,267,841 B1 * 9/2012 Allison ..... A63B 21/075 482/106
8,444,537 B1 5/2013 Santoro
9,138,607 B2 9/2015 Miranda et al.
9,597,544 B1 3/2017 Emick
11,698,253 B1 * 7/2023 Axe ..... A63B 21/4035 33/379
2011/0251033 A1 10/2011 Blancher
2013/0143724 A1 6/2013 DeMeo
2016/0016032 A1 1/2016 Haddad et al.
2018/0290007 A1 10/2018 Vorozilchak
2019/0148422 A1 6/2019 Leoniak

* cited by examiner

*Primary Examiner* — Zachary T Moore
(74) *Attorney, Agent, or Firm* — Malloy & Malloy, P.L.; Rafay Asrar

(57) ABSTRACT

The present invention is an adaptive dumbbell holder designed to incorporate a dumbbell into a pulley-based resistance machine for a wider range of exercises. The invention comprises a holder, shaped to securely receive a dumbbell, and the necessary elements for affixing the holder to a pulley system. Once a dumbbell is placed into the holder and the holder is integrated into the pulley system, the dumbbell serves as the resistance weight. This innovation brings versatility to dumbbell usage, eliminates the need for separate resistance machine weights, and enhances the transition between free-weight and machine-based exercises. The invention provides a cost-effective and space-efficient solution for expanding workout routines, promoting a more personalized and efficient exercise regimen, and enhancing the user's overall workout experience.

16 Claims, 7 Drawing Sheets

ADAPTIVE DUMBBELL HOLDER FOR INTERGRATION INTO A PULLEY SYSTEM FOR RESISTANCE EXERCISE

FIELD OF THE INVENTION

The present invention generally relates to exercise equipment, and more particularly, to an adaptive dumbbell holder capable of integrating dumbbells into a pulley system for resistance exercise. This apparatus aims to enhance the compatibility of free weights and resistance machines, expanding their usability and applicability within various exercise settings.

BACKGROUND OF THE INVENTION

Exercise and physical fitness have gained a substantial amount of attention over the years. This increased interest has led to the growth and diversification of the exercise equipment industry. Among the many types of exercise equipment available, dumbbells and resistance machines are two primary categories that have established their significance in strength training routines.

Dumbbells are among the most common types of exercise equipment, utilized by both amateur and professional fitness enthusiasts. They consist of a short bar with a weight at each end. Dumbbells are often used for joint-isolation exercises such as biceps curls, chest flies, or shoulder raises. The use of dumbbells offers a full range of motion for these exercises, which can promote muscle growth and improve overall physical fitness.

These pieces of equipment are considered free weights because they are not connected to a machine or an apparatus. This free characteristic provides a high degree of freedom in terms of movement, enabling users to perform a wide array of exercises that require varying movement patterns. This flexibility has contributed to the popularity of dumbbells as an indispensable tool for strength training.

Despite their benefits, however, the utilization of dumbbells is fundamentally limited to the direct physical handling by the user. This dependence creates restrictions, especially when the user wishes to perform exercises that are not easily accomplished with handheld weights, such as lat pulldowns, tricep pushdowns, and other exercises typically performed on cable machines. Therefore, while dumbbells are a versatile tool for strength training, their scope of use has certain limitations.

To supplement the utility of free weights, resistance machines have been developed and have found widespread use in gyms and fitness centers worldwide. These machines typically consist of a frame, a seat or platform for the user, and a set of weights that are manipulated using a system of cables and pulleys. This configuration enables users to perform a variety of exercises that target specific muscle groups with precision.

The weights in resistance machines are usually plate-loaded, meaning that they consist of flat, heavy discs that are stacked and integrated into the system. A pin or similar mechanism is used to select the desired weight for the exercise. The weights are lifted by pulling or pushing on handles, bars, or other grips connected to the cables, which run over the pulleys and lift the selected weights. This arrangement provides a constant level of resistance throughout the full range of motion, enabling an effective workout.

Resistance machines offer several advantages over free weights. They are safer to use, especially for beginners, because the weight is controlled and can't be dropped accidentally. They also allow users to perform exercises that target specific muscles, something that can be challenging to do with free weights. Moreover, resistance machines provide consistent resistance throughout the entire range of motion, providing a more standardized workout than free weights.

Despite the distinct advantages of both dumbbells and resistance machines, the current state of the art reveals a significant gap in their compatibility. This gap stems from the intrinsic design of these types of equipment: dumbbells are handheld free weights, while resistance machines are integrated, fixed systems. This incompatibility can cause inconvenience for users who wish to integrate the two types of equipment into their exercise routine.

For instance, a user who prefers the compactness and portability of dumbbells might also desire to engage in exercises typically performed on resistance machines. However, the transition from dumbbell-based exercises to machine-based exercises can be cumbersome and time-consuming. This transition may involve changing equipment, adjusting settings, or even moving to a different location in the gym, all of which can disrupt the flow of an exercise routine and decrease overall efficiency.

Additionally, although resistance machines offer consistent resistance and the ability to target specific muscles, they lack the inherent versatility and natural movement patterns offered by dumbbells. Consequently, an exercise regimen that incorporates both types of equipment may deliver the most comprehensive and effective workout.

However, due to the lack of compatibility between dumbbells and resistance machines, users are often compelled to choose one type of equipment over the other, limiting the potential benefits of their workout. This forced choice is a significant limitation of the current state of the art in exercise equipment.

Therefore, there is a pressing need in the exercise equipment industry for a versatile and efficient system that can bridge the gap between free weights and resistance machines. Such a system would ideally accommodate and integrate dumbbells into a pulley-based resistance machine system, thereby combining the advantages of both types of equipment. This integration would offer a wider array of exercise options, enhance workout efficiency, and improve overall user satisfaction.

SUMMARY OF THE INVENTION

The present invention pertains to an innovative adaptive dumbbell holder that can integrate a dumbbell into a pulley system for resistance exercises. The invention comprises a holder, specifically designed to securely receive a dumbbell, and means for attaching this holder to a pulley system. When the dumbbell is received by the holder and the holder is affixed to the pulley system, the dumbbell can function as a weight within the pulley system. This allows the user to perform resistance exercises using the dumbbell weight, substantially broadening the versatility and application of standard dumbbells.

The present invention, an adaptive dumbbell holder designed for integration into a pulley system, offers substantial improvements over the prior art in the realm of exercise equipment. Unlike traditional setups, which necessitate the distinct use of either dumbbells or resistance machines, this invention merges the advantages of both. Firstly, it offers unparalleled versatility, enabling users to utilize their existing dumbbells for exercises typically limited to plate-loaded resistance machines. This eliminates the need for additional weights or equipment, leading to significant cost and space savings. Moreover, the seamless transition it facilitates between free-weight and machine-based exercises ensures workout efficiency, eliminating the cumbersome process of switching between distinct equipment types. In essence, this invention amplifies the utility of dumbbells, delivering a more personalized, expansive, and effective exercise regimen while addressing and overcoming the limitations presented by prior art in the fitness domain.

In a first implementation of the invention, a dumbbell holder comprises:

a first portion having a first outer surface and a second inner surface, the first outer surface and the second inner surface forming a semi-circular body; and a second portion having a third outer surface and fourth inner surface, the third outer surface and the fourth inner forming a second semi-circular body, the second portion being symmetrical to the first portion; wherein a hinge connects the first portion to the second portion such that both the first portion and the second portion are rotatable and lock into one another to form a closed position, the combination of the first portion and the second portion defining a cavity configured to hold a dumbbell when the dumbbell holder is in the closed position.

In a second aspect, the first outer surface may be convex.

In another aspect, the second inner surface may be concave.

In another aspect, the first portion may include a first top edge, a first bottom edge, and a first side edge.

In another aspect, the third outer surface may be convex.

In another aspect, the fourth inner surface may be concave.

In another aspect, the second portion may include a second top edge, a second bottom edge, and a second side edge.

In another aspect, the second inner surface of the first portion and the fourth inner surface of the second portion may further define the cavity.

In another aspect, the first portion may further include a first protrusion on the first outer surface, the first protrusion including a first opening.

In another aspect, the first protrusion may further include a male end locking mechanism.

In another aspect, the second portion may further include a second protrusion on the second outer surface, the second protrusion including a second opening.

In another aspect, the second protrusion may further include a female end locking mechanism.

In another aspect, the male end locking mechanism mates with the female end locking mechanism upon the dumbbell holder being in a closed position, the first protrusion and the second protrusion defining a handle.

In another aspect, the second inner surface and the fourth inner surface may contain a padding.

In another aspect, the padding may be comprised of a foamlike material.

In another aspect, the hinge may be a ball-bearing hinge.

In a second implementation of the invention, a method of assembling the dumbbell system with attachable weights comprises:

obtaining a dumbbell holder, the dumbbell holder having a first portion having a first outer surface and a second inner surface, the first outer surface and the second inner surface forming a semi-circular body, a second portion having a third outer surface and fourth inner surface, the third outer surface and the fourth inner forming a second semi-circular body, the second portion being symmetrical to the first portion, wherein a hinge connects the first portion to the second portion such that both the first portion and the second portion are rotatable and lock into one another to form a closed position, the combination of the first portion and the second portion defining a cavity configured to hold a dumbbell when the dumbbell holder is in the closed position;

placing a dumbbell within the cavity of the first portion or second portion;

rotating both the first portion or the second portion such that the first portion and the second portion lock into one another and enter into the closed position, and attaching the dumbbell holder about a pulley system such that the dumbbell within the dumbbell holder is used as a resistance weight.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a dumbbell holder that is designed and configured to facilitate affixation of dumbbells and other free weights to a pulley system. The dumbbell holder may include a first portion having an interior and an exterior surface, a second portion having another interior and exterior surface, and a hinge that allows both the first and second portion to rotate and lock into one another, defining a cavity configured to hold a dumbbell. In a closed position, the dumbbell holder may include a handle configured to allow a user to latch carabineer to a dumbbell placed within the cavity of the dumbbell holder such that the dumbbell may then be attached to a pulley system for use in resistance exercises. Additionally, the handle may include a locking mechanism configured to lock the dumbbell holder in the closed position.

Figure 1:
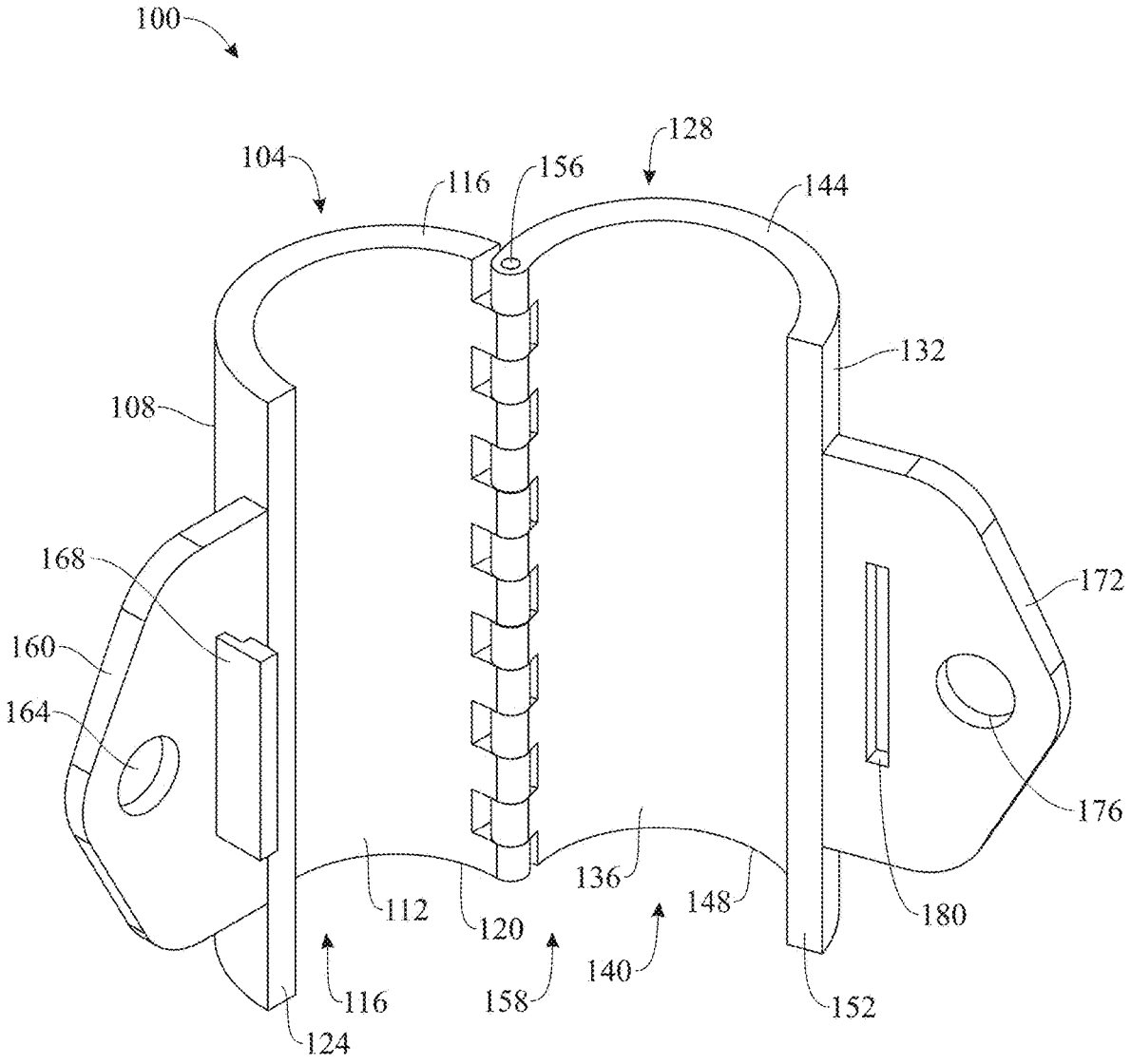
FIG. 1 presents a front isometric view of a dumbbell holder in accordance with a first illustrative embodiment of the invention, shown with the holder in an open position.
Figure 2:
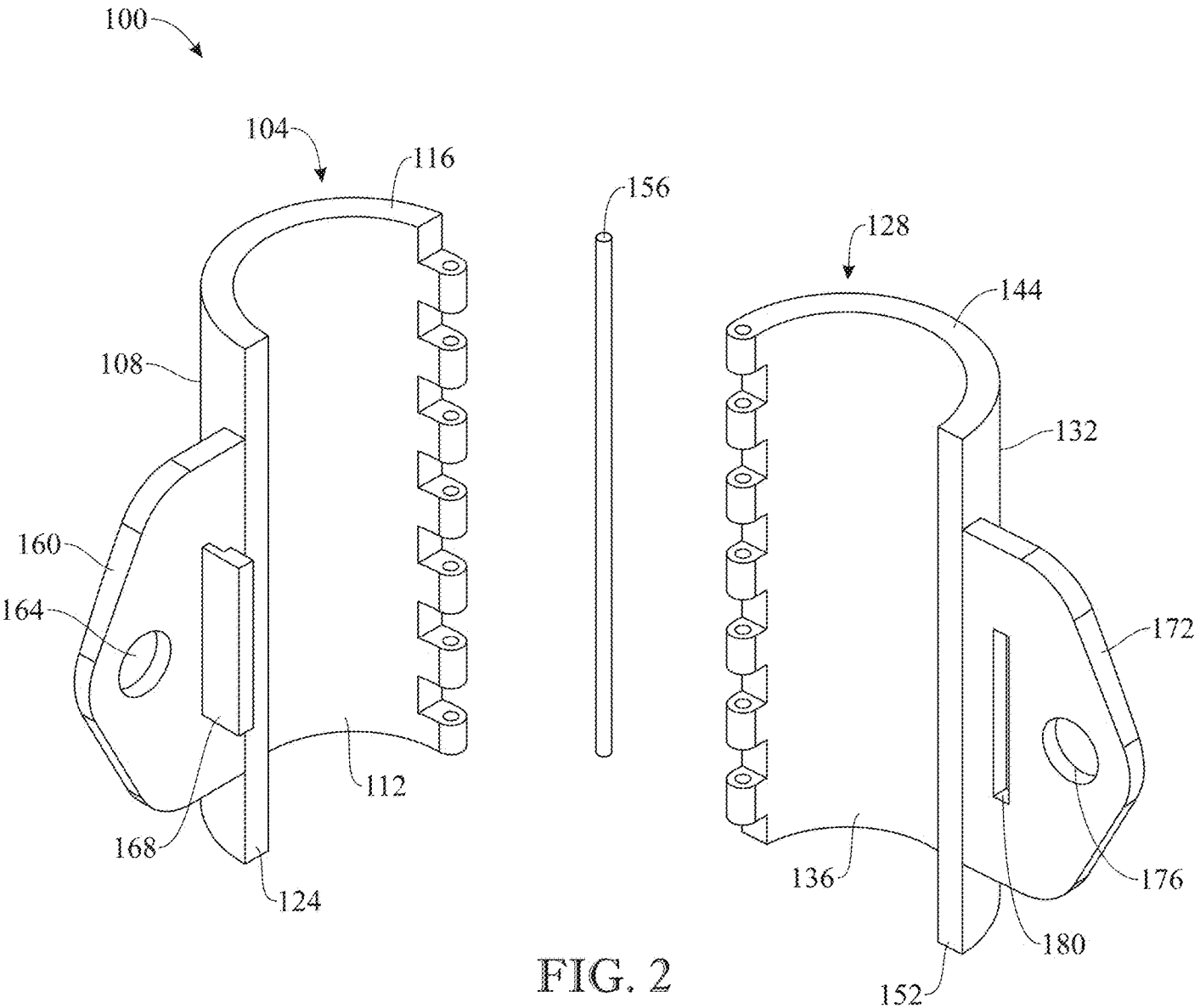
FIG. 2 presents an exploded, front isometric view of the dumbbell holder illustrated in FIG. 1.

Referring initially to FIGS. 1-2, a dumbbell holder 100 is illustrated in accordance with an exemplary embodiment of the present invention. As shown, the dumbbell holder 100 includes a first portion 104. The first portion 104 may include a first outer surface 108 and a second inner surface 112. In the preferred embodiment, the first outer surface 108 may be convex, while the second inner surface 112 may be concave. The first outer surface 108 and the second inner surface 112 may form a first semi-circular body 116. The first portion 104 may further include a first top edge 116, a first bottom edge 120, and a first side edge 124. The first top edge 116, first bottom edge 120, and first side edge 124 may further define the semi-circular body 116.

With continued reference to FIGS. 1-2, the dumbbell holder may include a second portion 128. The second portion 128 may be symmetrical to the first portion 104. As such, the second portion 128 may include third outer surface 132 and a fourth inner surface 136. Similar to the first portion 104, the third outer surface 132 may be convex and the fourth inner surface 136 may be concave. Together, the third outer surface 132 and the fourth inner surface 136 may form a second semi-circular body 140. The second portion 128 may further include a second top edge 144, a second bottom edge 148, and a second side edge 152. The second top edge 144, the second bottom edge 148, and the second side edge 152 may further define the second semi-circular body 140.

With particular reference to FIG. 2, the dumbbell holder may further include a hinge 156. The hinge 156 may connection the first portion 104 to the second portion 128. More particularly, the hinge 156 may be a ball-bearing hinge as in present embodiment. However, embodiments are envisioned wherein the hinge 156 may be of any type that may facilitate a connection between the first portion 104 and the second portion 128. Additionally, the hinge 156 facilitates rotation of both the first portion 104 and the second portion 128, as best shown in FIG. 3.

Figure 3:
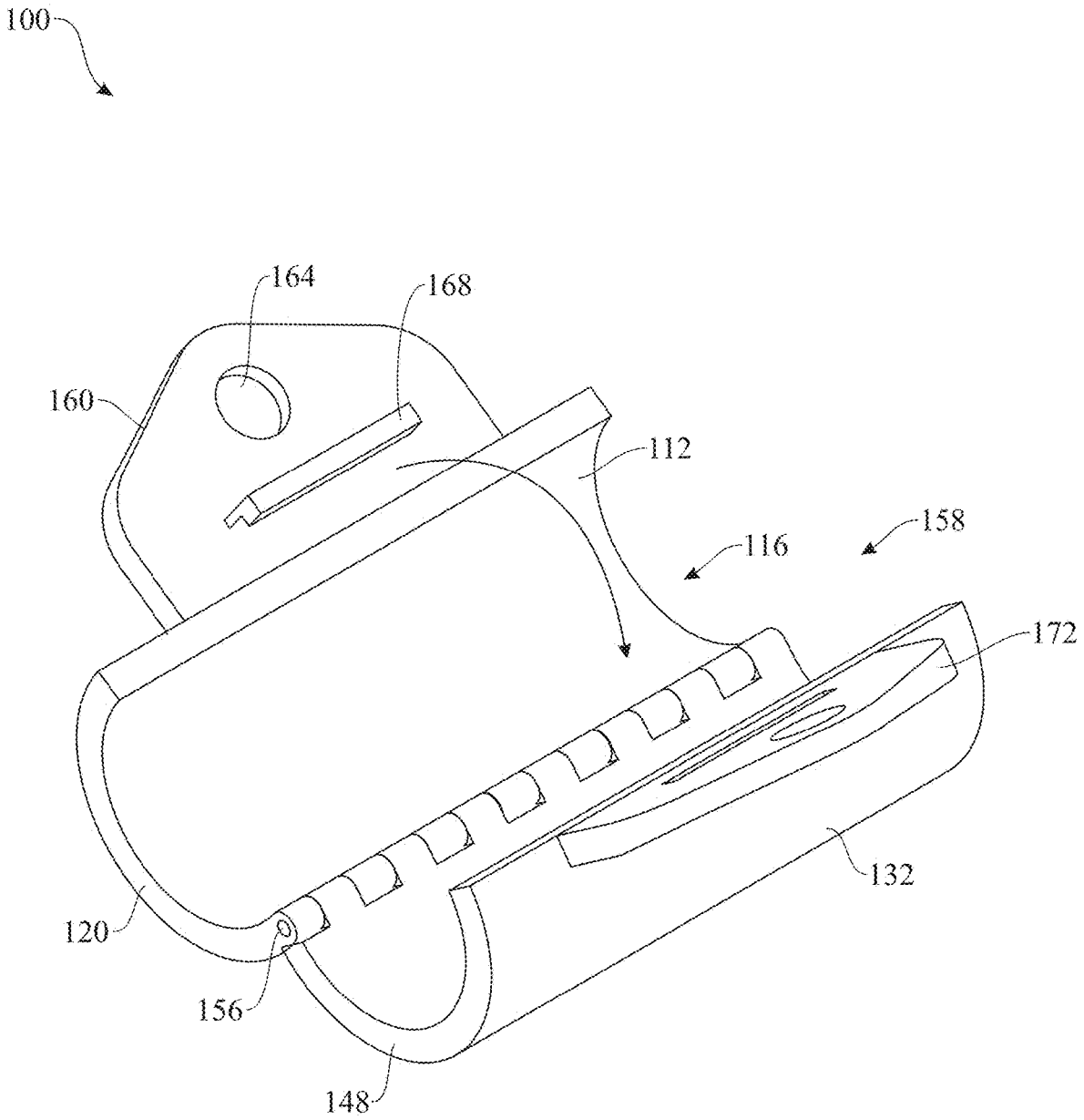
FIG. 3 presents a perspective view of the dumbbell holder illustrated in FIG. 1, shown being put into a closed position.
Figure 4:
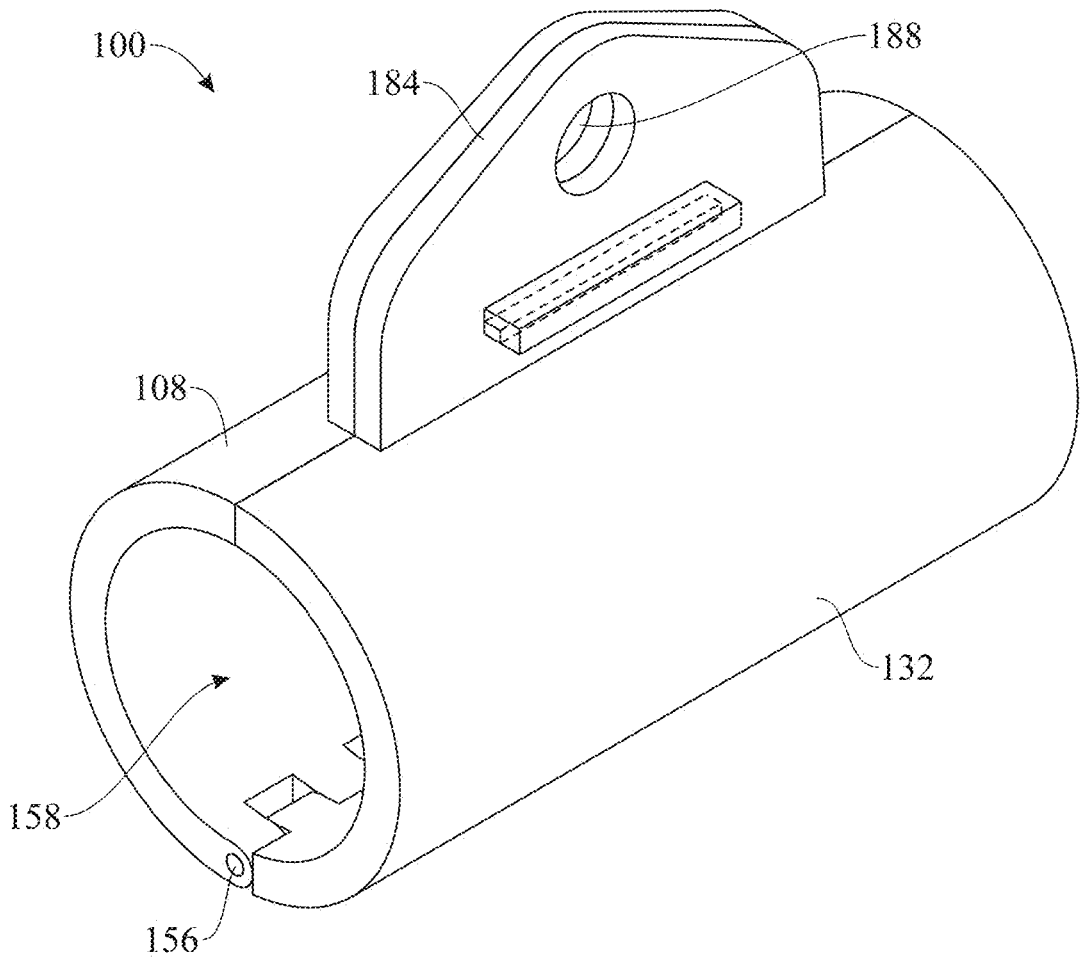
FIG. 4 presents a perspective view of the dumbbell holder illustrated in FIG. 3, shown in a closed position.
Figure 6:
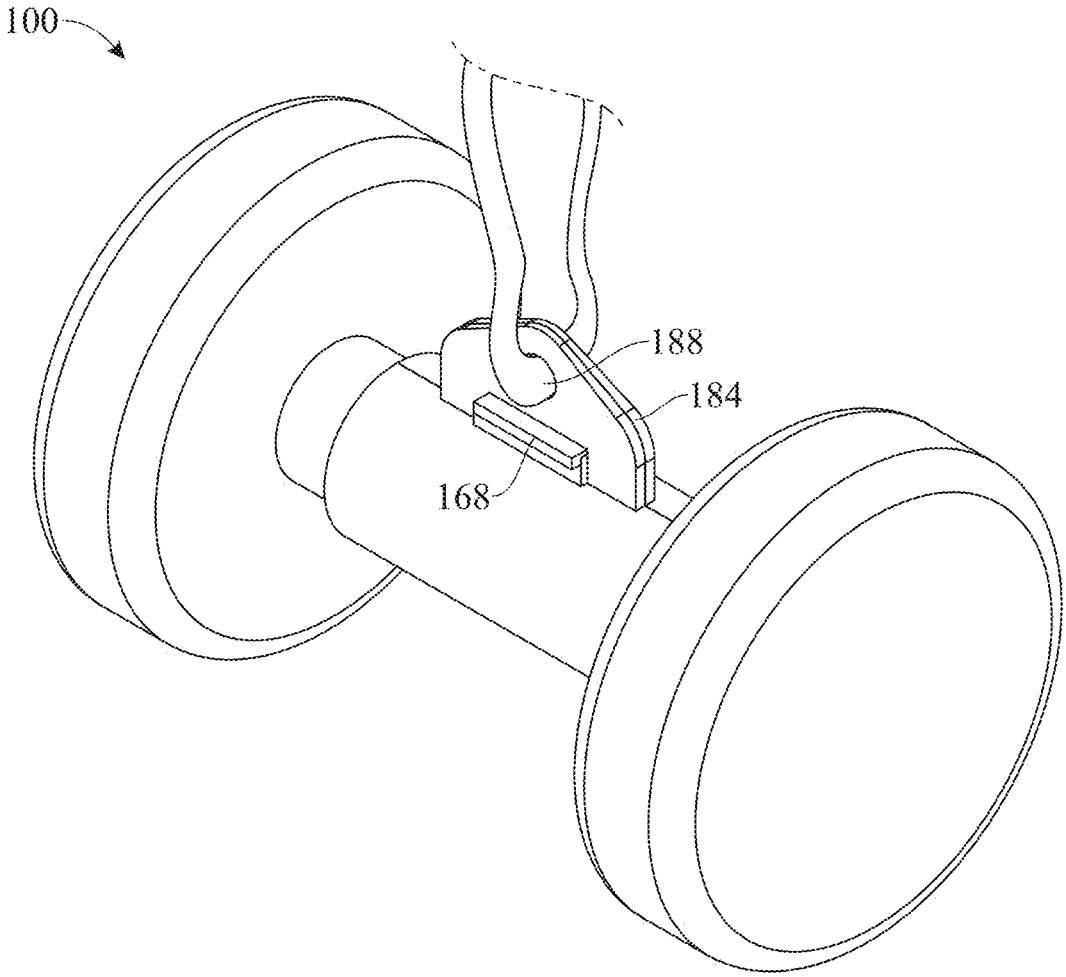
FIG. 6 presents a perspective of the dumbbell holder illustrated in FIG. 1, shown with a carabiner attached to the handle.

With continued reference to FIG. 3, the second inner surface 112 of the first portion 104 and the fourth inner surface 136 of the second portion 128 may define a cavity 158. The cavity 158 may be configured to hold a dumbbell when the dumbbell holder 100 is in a closed position, as shown in FIG. 4 and FIG. 6.

Referring back to FIGS. 1-2, the first portion 104 may include a first protrusion 160 on the first outer surface 108. The first protrusion 160 may include a first opening 164. The first opening 164 may be circular in shape, however embodiments are envisioned wherein the first opening 164 configured to accept a carabiner, as shown in FIG. 6. Referring back to FIGS. 1-2, the first opening 164 may further include a male end locking mechanism 168. The male end locking mechanism 168 may, for instance, be a latch or any other means configured to attach a female end locking mechanism.

Figure 5:
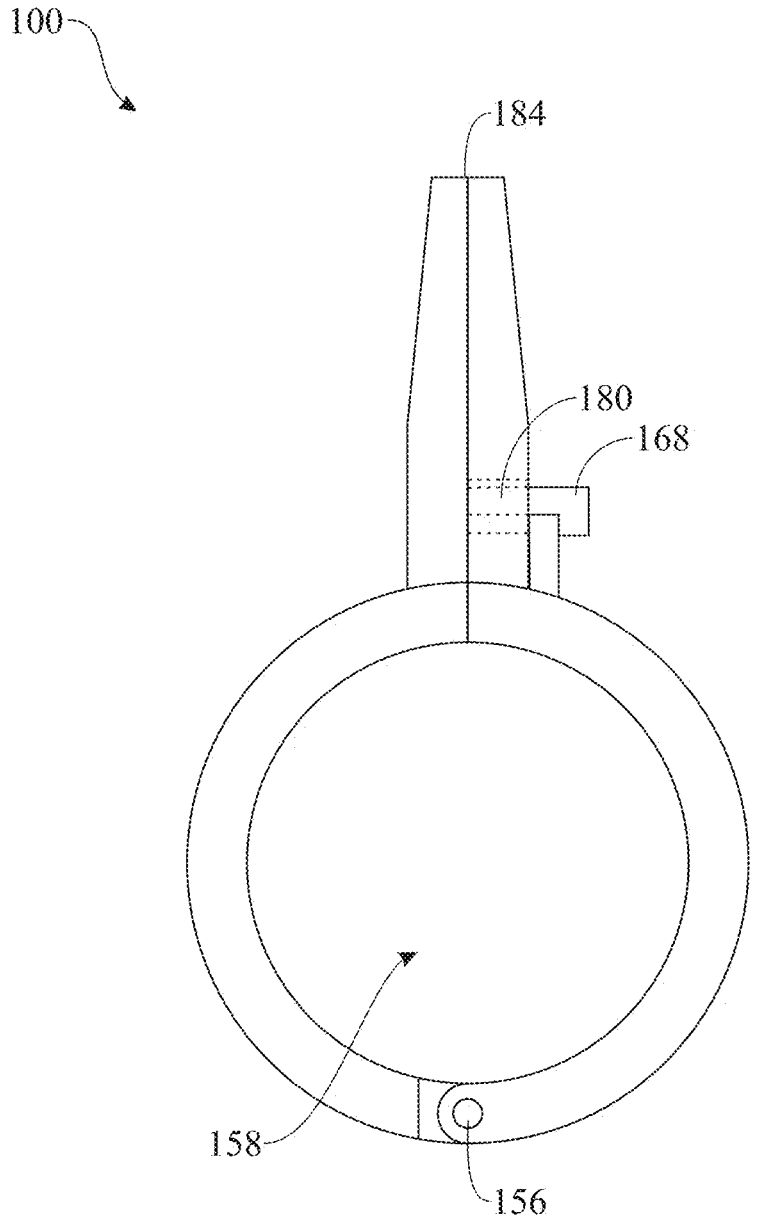
FIG. 5 presents a top plan view of the dumbbell holder illustrated in FIG. 4, shown in a closed position.

With continued reference to FIGS. 1-2, the second portion 128 may include a second protrusion 172. The second protrusion 172 may extend out of the third outer surface 132. Similar to the first protrusion 160, the second protrusion 172 may include a second opening 176. The second opening 176 may be of the same type and the same size as the first opening 164 of the first protrusion 160. The second protrusion 172 may also contain a female end 180 locking mechanism. The female end locking mechanism 180 may be configured to accept the male locking mechanism 168 of the first protrusion 160. The male end locking mechanism 168 mates with the female end locking mechanism 180 upon the dumbbell holder being in a closed position, as best shown in FIGS. 4-6. The first protrusion 160 and the second protrusion 172 may further define a handle 184 with a circular slot 188. The circular slot 188 may be defined by the first opening 164 and the second opening 176 meeting when the dumbbell holder 100 is in the close position.

The illustrations of FIGS. 3-6 demonstrate an example method of operation of the dumbbell holder 100. Referring initially to FIG. 3, the hinge 156 connects the first portion 104 to the second portion 128 such that both the first portion 104 and the second portion 128 are rotatable and lock into one another to form a closed position. Prior to placing the dumbbell holder 100 in the closed position, a dumbbell may be placed within the second inner surface 112 and the fourth inner surface 136 of the first semi-circular body 116 and the second semi-circular body 140 defining the cavity 158. The cavity 158 is configured to accept a handle portion of a dumbbell.

Figure 7:
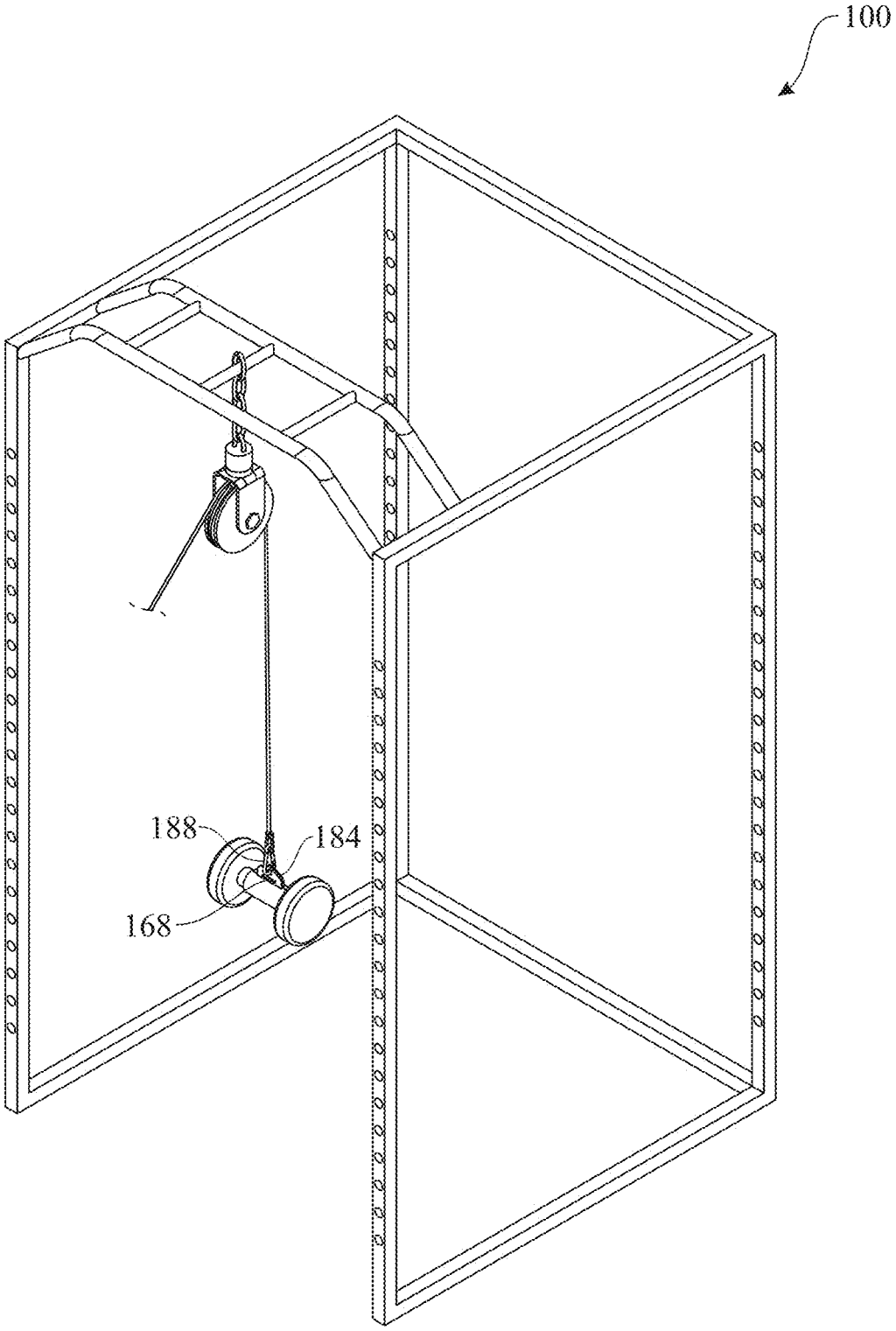
FIG. 7 presents a perspective view of the dumbbell holder illustrated in FIG. 1, shown with the dumbbell holder attached to a pulley system.

With continued reference to FIGS. 4-6, upon placement of a dumbbell into the cavity 158, the dumbbell holder 100 may be placed into the closed position my rotation both the first portion 104 and the second portion 128 such that the first protrusion 160 locks into the second protrusion 164. More particularly, as shown in FIG. 5, the male end locking mechanism 168 may lock into the female end locking mechanism 180 to form the handle 184. Once the dumbbell holder 100 is in the closed position, it is ready for attachment to a pulley system. The first opening 164 and the second opening 176 may come together to form the aforementioned slot 188, the slot 188 allowing a carabiner to be latched into each, as best shown in FIG. 6. The slot 188 by allowing a carabiner to be latched into may also allow for a dumbbell in the dumbbell holder 100 to be connected to a pulley, as best shown in FIG. 7. This may allow for the dumbbell holder 100 to have dumbbell mimic weight plates in more complex exercises machines.

Alternative embodiments are contemplated to those shown or described herein without departing from the scope of the present disclosure. For example, embodiments are contemplated in which the first portion and the second portion of the dumbbell holder are extendable. This may allow the dumbbell holder to accommodate dumbbell of varying lengths. Additionally, embodiments are considered wherein the cavity of the dumbbell holder has padding. This would allow the dumbbell holder to protect dumbbells and other free weights from wear.

In summary, the present invention provides an innovative solution for integrating dumbbells into a pulley-based resistance exercise system. The invention, comprising an adaptive dumbbell holder, successfully bridges the gap between free weights and resistance machines, introducing a new level of versatility and efficiency in strength training routines. The invention's unique design enables it to securely receive a dumbbell and affix to a pulley system, transforming the dumbbell into a resistance weight for machine-based exercises. This allows users to utilize their existing dumbbells for a wider array of exercises, enhancing workout flow, and promoting a more personalized and effective exercise regimen. Furthermore, it offers a cost-effective and space-efficient alternative to purchasing separate weights for resistance machines. Therefore, the present invention significantly enhances the overall user experience in strength training, aligning with the growing needs and expectations in the field of exercise equipment.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A dumbbell holder comprising:

a first portion having a first outer surface and a second inner surface, the first outer surface and the second inner surface forming a semi-circular body;

and a second portion having a third outer surface and fourth inner surface, the third outer surface and the fourth inner forming a second semi-circular body, the second portion being symmetrical to the first portion;

wherein a hinge connects the first portion to the second portion such that both the first portion and the second portion are rotatable and lock into one another to form a closed position, the combination of the first portion and the second portion defining a cavity configured to hold a dumbbell when the dumbbell holder is in the closed position;

wherein the first portion further includes a first protrusion on the first outer surface, the first protrusion including a first opening;

wherein the second portion further includes a second protrusion on the second outer surface, the second protrusion including a second opening;

wherein the handle includes a circular slot, the slot being defined by the first opening and the second opening; and wherein the slot is configured to allow the dumbbell holder to connect to carabiner, and further wherein the carabiner is configured to latch onto a pulley system.

2. The dumbbell holder of claim 1, wherein the first outer surface is convex.

3. The dumbbell holder of claim 1, wherein the second inner surface is concave.

4. The dumbbell holder of claim 1, wherein the first portion includes a first top edge, a first bottom edge, and a first side edge.

5. The dumbbell holder of claim 1, wherein the third outer surface is convex.

6. The dumbbell holder of claim 1, wherein the fourth inner surface is concave.

7. The dumbbell holder of claim 1, wherein the second portion includes a second top edge, a second bottom edge, and a second side edge.

8. The dumbbell holder of claim 1, wherein the second inner surface of the first portion and the fourth inner surface of the second portion further define the cavity.

9. The dumbbell holder of claim 1, wherein the first protrusion includes a male end locking mechanism.

10. The dumbbell holder of claim 9, wherein the second protrusion further includes a female end locking mechanism.

11. The dumbbell holder of claim 10, wherein the male end locking mechanism mates with the female end locking mechanism upon the dumbbell holder being in a closed position, the first protrusion and the second protrusion defining a handle.

12. The dumbbell holder of claim 1, wherein the second inner surface and the fourth inner surface may contain a padding.

13. The dumbbell holder of claim 1, wherein the padding is comprised of a foamlike material.

14. The dumbbell holder of claim 1, wherein the hinge is a ball-bearing hinge.

15. A dumbbell holder comprising:

a first portion having a first outer surface and a second inner surface, the first outer surface and the second inner surface forming a semi-circular body, wherein the first portion further includes a first protrusion on the first outer surface, the first protrusion including a first opening; and a second portion having a third outer surface and fourth inner surface, the third outer surface and the fourth inner forming a second semi-circular body, the second portion being symmetrical to the first portion, wherein the second portion further includes a second protrusion on the second outer surface, the second protrusion including a second opening;

a male end locking mechanism provided on the first protrusion and a female end locking mechanism provided on the second protrusion, wherein the male end locking mechanism mates with the female end locking mechanism upon the dumbbell holder being in a closed position, the first protrusion and the second protrusion defining a handle;

a circular slot provided on the handle, defined by the first opening and the second opening, wherein the slot is configured to allow the dumbbell holder to connect to carabiner, and further wherein the carabiner is configured to latch onto a pulley system; and a hinge connecting the first portion to the second portion such that both the first portion and the second portion are rotatable and lock into one another to form the closed position, the combination of the first portion and the second portion defining a cavity configured to hold a dumbbell when the dumbbell holder is in the closed position.

16. A dumbbell holder comprising:

a first portion having a first outer surface and a second inner surface, the first outer surface and the second inner surface forming a semi-circular body, wherein the first portion further includes a first protrusion on the first outer surface, the first protrusion including a first opening, and further wherein the first portion includes a first top edge, a first bottom edge, and a first side edge; and a second portion having a third outer surface and fourth inner surface, the third outer surface and the fourth inner forming a second semi-circular body, the second portion being symmetrical to the first portion, wherein the second portion further includes a second protrusion on the second outer surface, the second protrusion including a second opening, and further wherein the second portion includes a second top edge, a second bottom edge, and a second side edge;

a male end locking mechanism provided on the first protrusion and a female end locking mechanism provided on the second protrusion, wherein the male end locking mechanism mates with the female end locking mechanism upon the dumbbell holder being in a closed position, the first protrusion and the second protrusion defining a handle;

a circular slot provided on the handle, defined by the first opening and the second opening, wherein the slot is configured to allow the dumbbell holder to connect to carabiner, and further wherein the carabiner is configured to latch onto a pulley system; and a hinge connecting the first portion to the second portion such that both the first portion and the second portion are rotatable and lock into one another to form the closed position, the closed position being further defined when the first bottom edge and the second bottom edge meet, the combination of the first portion and the second portion defining a cavity configured to hold a dumbbell when the dumbbell holder is in the closed position.

* * * * *